US009406233B2

(12) United States Patent
Jo

(10) Patent No.: US 9,406,233 B2
(45) Date of Patent: Aug. 2, 2016

(54) APPARATUS AND METHOD FOR WARNING OF DANGEROUS PASSING OF VEHICLE

(71) Applicant: HYUNDAI MOBIS CO., LTD., Seoul (KR)

(72) Inventor: Jang Hyeon Jo, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 14/479,040

(22) Filed: Sep. 5, 2014

(65) Prior Publication Data

US 2015/0070194 A1 Mar. 12, 2015

(30) Foreign Application Priority Data

Sep. 10, 2013 (KR) ..... 10-2013-0108726

(51) Int. Cl.
*G08G 1/09* (2006.01)
*G08G 1/16* (2006.01)

(52) U.S. Cl.
CPC ..... *G08G 1/167* (2013.01); *G08G 1/163* (2013.01); *G08G 1/166* (2013.01)

(58) Field of Classification Search
CPC ..... G08G 1/163; G08G 1/166; G08G 1/167; G08G 1/096791; B60W 50/14; B60W 40/09; H04W 4/046; B60R 25/33; G01C 21/26; G01C 21/3658
USPC ..... 340/905, 436, 435; 701/1, 96, 117, 301
See application file for complete search history.

(56) References Cited

U.S. PATENT DOCUMENTS 8,060,260 B2 * 11/2011 Huang ..... B60W 30/12 701/96
8,847,787 B2 * 9/2014 Goudy ..... G08G 1/163 340/436
8,990,001 B2 * 3/2015 Goudy ..... G08G 1/166 340/436
9,020,728 B2 * 4/2015 Goudy ..... G08G 1/166 701/70

(Continued)

FOREIGN PATENT DOCUMENTS

CN 102806911 A 12/2012
JP 2011-120232 A 6/2011
KR 10-1999-0062012 A 7/1999

OTHER PUBLICATIONS

Office Action dated Feb. 29, 2016 of corresponding Chinese Patent Application No. 201410342491.8-11 pages.

*Primary Examiner* — John A Tweel, Jr.
(74) *Attorney, Agent, or Firm* — Knobbe Martens Olson & Bear LLP

(57) ABSTRACT

An apparatus for warning of dangerous passing of a vehicle may include: a vehicle information collector configured to collect vehicle information containing one or more of vehicle speed, traveling direction, and location; a vehicle information transmitter/receiver configured to transmit the vehicle information collected through the vehicle information collector, and receive other vehicle information transmitted from other vehicles; a controller configured to determine the direction of a lane change signal when the lane change signal is inputted, and determine whether to output a warning based on the vehicle information collected through the vehicle information collector and the other vehicle information received through the vehicle information transmitter/receiver; and a warning output unit configured to output a warning according to the determination of the controller.

11 Claims, 3 Drawing Sheets

(56) References Cited

U.S. PATENT DOCUMENTS

| | | | | |
|---|---|---|---|---|
| 9,031,776 | B2 * | 5/2015 | Goudy | G08G 1/167 701/301 |
| 2010/0023180 | A1 * | 1/2010 | Huang | B60W 30/12 701/1 |
| 2010/0023245 | A1 * | 1/2010 | Huang | B60W 40/09 701/117 |
| 2010/0209883 | A1 * | 8/2010 | Chin | G09B 19/167 434/65 |
| 2010/0209885 | A1 * | 8/2010 | Chin | G09B 19/167 434/65 |
| 2014/0148998 | A1 * | 5/2014 | Goudy | G08G 1/163 701/301 |
| 2014/0148999 | A1 * | 5/2014 | Goudy | G08G 1/163 701/301 |
| 2015/0148985 | A1 * | 5/2015 | Jo | G08G 1/096791 701/1 |
| 2015/0254977 | A1 * | 9/2015 | Grabow | G08G 1/096791 340/903 |

* cited by examiner

APPARATUS AND METHOD FOR WARNING OF DANGEROUS PASSING OF VEHICLE

CROSS-REFERENCES TO RELATED APPLICATIONS

The present application claims priority to Korean application number 10-2013-0108726, filed on Sep. 10, 2013, which is incorporated by reference in its entirety.

BACKGROUND

The present disclosure relates to an apparatus and method for warning of dangerous passing of a vehicle, and more particularly, to an apparatus and method for warning of dangerous passing of a vehicle, which warns a driver of a danger when the danger is sensed while a vehicle passes a forward vehicle on a road corresponding to a passing-allowed section, thereby reducing accidents related to passing.

Recently, a variety of techniques related to the transportation safety service, such as an ESS (Emergency Stop Signal) system, an FCWS (Front Collision Warning System), and an emergency vehicle preemption signal control system, have been developed through V2V (Vehicle-to-Vehicle) communication and V2I (Vehicle-to-Infrastructure) communication based on WAVE (Wireless Access in Vehicular Environments) technology.

The WAVE technology is a core technique of an intelligent highway system which enables the V2V communication and the V2I communication. Unlike the wireless LAN, the WAVE technology can perform communication even while a vehicle travels at a high speed of 180 km/h, and has a transmission capability 10 times larger than DSRC (Dedicated Short Range Communication) used for Hi-Pass in Korea. Thus, the WAVE technology is highly valued as a next-generation technology.

The transportation safety service-related techniques based on the WAVE technology may provide road traffic information anywhere in real time, and assist a driver to travel safely and comfortably even during bad weather or emergency state.

Furthermore, the transportation safety service-related techniques are expected to optimize the transportation system. For example, the techniques may not only prevent traffic accidents, but also achieve the efficiency of traffic flow.

The related art is disclosed in Korean Patent Laid-open Publication No. 10-1999-0062012 published on Jul. 26, 1999, and entitled "Apparatus for indicating and alarming passing possibility".

SUMMARY

Embodiments of the present invention are directed to an apparatus and method for warning of dangerous passing of a vehicle, which determines whether information on a vehicle traveling in the opposite direction and a passing-required distance are secured through V2V (Vehicle-to-Vehicle) communication and V2I (Vehicle-to-Infrastructure) communication based on WAVE (Wireless Access in Vehicular Environments) technology, when a vehicle is intended to pass a forward vehicle on a road corresponding to a passing-allowed section, and warns a driver of a danger when the danger is sensed, such that the passing is safely performed.

In one embodiment, an apparatus for warning of dangerous passing of a vehicle may include: a vehicle information collector configured to collect vehicle information containing one or more of vehicle speed, traveling direction, and location; a vehicle information transmitter/receiver configured to transmit the vehicle information collected through the vehicle information collector, and receive other vehicle information transmitted from other vehicles; a controller configured to determine the direction of a lane change signal when the lane change signal is inputted, and determine whether to output a warning based on the vehicle information collected through the vehicle information collector and the other vehicle information received through the vehicle information transmitter/receiver; and a warning output unit configured to output a warning according to the determination of the controller.

The controller may calculate a distance required for passing a forward vehicle when the forward vehicle is sensed through the other vehicle information, and output the warning when a vehicle on the other lane is sensed within the calculated passing required distance.

The controller may calculate the passing required distance by adding a first distance, a second distance, and a third distance, and the first distance may correspond to a distance from the location of the front bumper of the vehicle, collected through the vehicle information collector, to the location of the rear bumper of the forward vehicle, sensed through the other vehicle information, the second distance may correspond the length of the forward vehicle, contained in the other vehicle information, and the third distance may correspond a preset distance between the forward vehicle before passed and the vehicle after passing the forward vehicle.

The controller may collect information on a lane located in the determined direction of the lane change signal from a GPS (Global Positioning System) module included in the vehicle information collector, and output a passing prohibit warning when the lane is not a passing-allowed section.

The vehicle information transmitter/receiver may communicate with the forward vehicle and the vehicle on the other lane through a communication standard based on WAVE technology.

The warning output unit may output the warning using one or more of a warning sound, a warning light, a warning comment, and a warning image, and change the output intensity or color of the warning according to the location of the vehicle on the other lane.

The controller may cancel the output warning when the input of the lane change signal through a direction indication switch is stopped or the vehicle on the other lane is not sensed within a distance required for passing the forward vehicle.

In another embodiment, a method for warning of dangerous passing of a vehicle may include: determining, by a controller, whether a lane change signal is inputted through a direction indication switch; determining, by the controller, the direction of the lane change signal when the lane change signal is inputted, and determining whether to output a warning using vehicle information collected through a vehicle information collector and other vehicle information received through a vehicle information transmitter/receiver; and outputting, by the controller, a warning according to the determination.

The determining of whether to output the warning may include calculating a distance required for passing a forward vehicle when the forward vehicle is sensed through the other vehicle information, and outputting the warning when a vehicle on the other lane is sensed within the calculated passing required distance.

The passing required distance may be calculated by adding a first distance, a second distance, and a third distance, and the first distance may correspond to a distance from the location of the front bumper of the vehicle, collected through the vehicle information collector, to the location of the rear bumper of the forward vehicle, sensed through the other vehicle information, the second distance may correspond to the length of the forward vehicle, contained in the other vehicle information, and the third distance may correspond to a preset distance between the forward vehicle before passed and the vehicle after passing the forward vehicle.

The determining of whether to output the warning may include collecting information on a lane located in the determined direction of the lane change signal from a GPS module included in the vehicle information collector, and determining to output a passing prohibition warning, when the lane is not a passing-allowed section.

The outputting of the warning according to the determination may include outputting the warning using one or more of a warning sound, a warning light, a warning comment, and a warning image, and changing the output intensity or color of the warning according to the location of the vehicle on the other lane.

The method may include canceling the warning output when the input of the lane change signal through the direction indication switch is stopped or the vehicle on the other lane is not sensed within a distance required for passing the forward vehicle.

In accordance with the embodiments of the present invention, when a vehicle is intended to pass a forward vehicle on a road corresponding to a passing-allowed section, the apparatus for warning of dangerous passing of a vehicle may determine whether information on a vehicle traveling in the opposition direction and a passing-required distance are sufficiently secured, through the V2V communication and V2I communication based on the WAVE technology. When determining that passing is dangerous, the apparatus for warning of dangerous passing of a vehicle may warn a driver of the dangerous passing such that the driver stably passes a vehicle, thereby reducing accidents related to passing.

DESCRIPTION OF SPECIFIC EMBODIMENTS

Hereafter, an apparatus and method for warning of dangerous passing of a vehicle will be described in detail with reference to the accompanying drawings.

It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

In general, when a vehicle is intended to pass a forward vehicle traveling at low speed in a passing-allowed section of a two-lane road, a driver drives over the center line to pass the forward vehicle. At this time, the driver must recognize the forward vehicle and a vehicle traveling in the opposite direction at the same time, and determine whether a passing required distance is sufficiently secured, in order to pass the forward vehicle. However, the driver cannot accurately recognize a vehicle traveling in the opposite direction in a curved section where the driver's view is not secured, and an inexperienced driver cannot accurately determine a passing required distance. In this case, a lot of passing-related accidents such as a head-on collision may occur.

Figure 1:
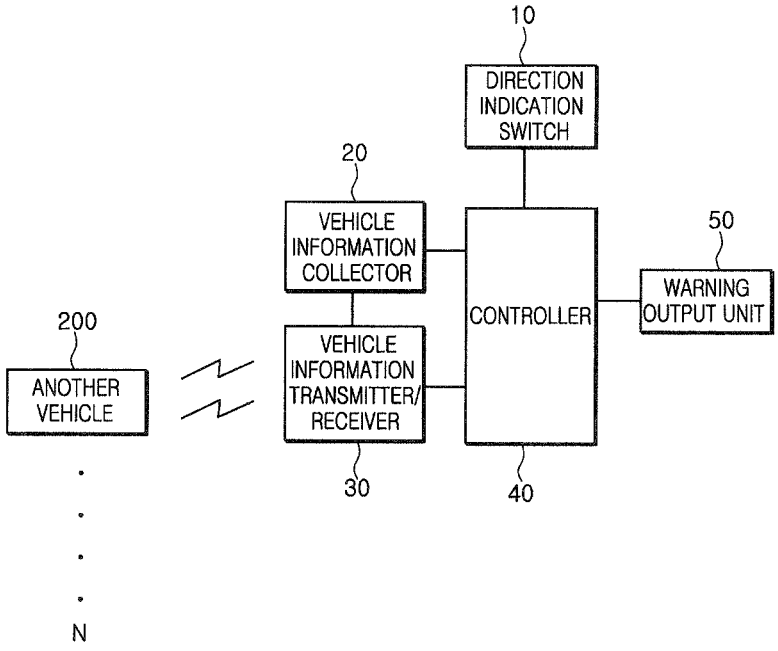
FIG. 1 is a block configuration diagram of an apparatus for warning of dangerous passing of a vehicle in accordance with an embodiment of the present invention.
Figure 2:
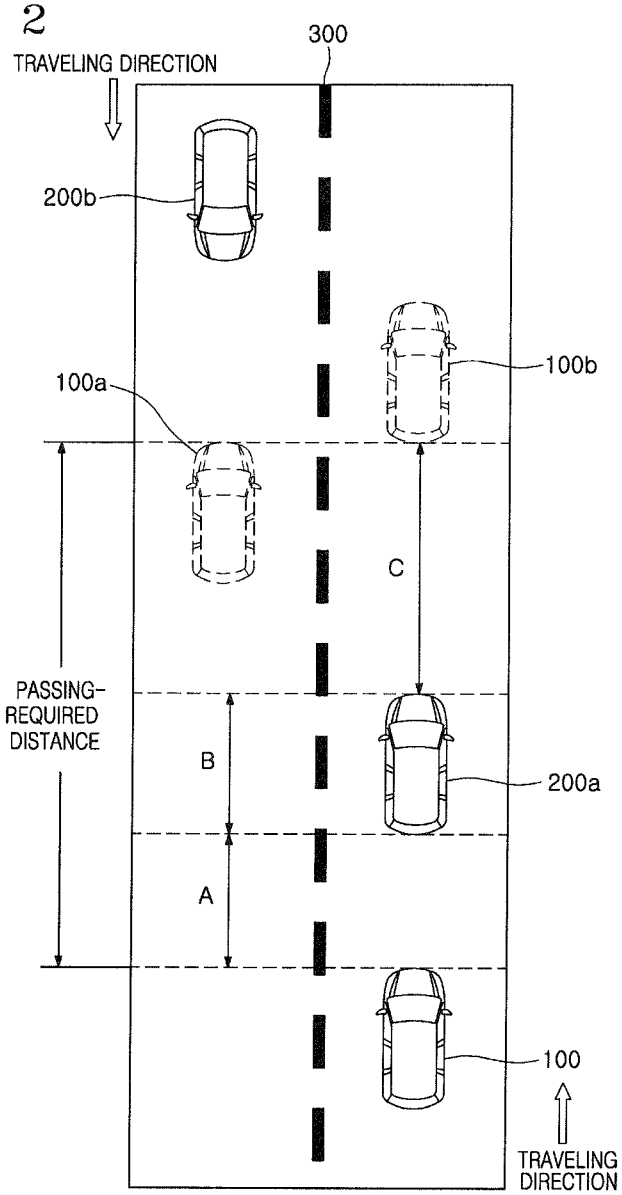
FIG. 2 is a diagram for explaining the apparatus for warning of dangerous passing of a vehicle in accordance with the embodiment of the present invention.

FIG. 1 is a block configuration diagram of an apparatus for warning of dangerous passing of a vehicle in accordance with an embodiment of the present invention. FIG. 2 is a diagram for explaining the apparatus for warning of dangerous passing of a vehicle in accordance with the embodiment of the present invention.

In the embodiment of the present invention, a passing-allowed section of a two-lane road will be taken as an example for description. Thus, a vehicle 200*b* on the other lane may be defined as a vehicle which travels in the opposite direction based on the center line 300.

As illustrated in FIG. 1, the apparatus for warning of dangerous warning of a vehicle in accordance with the embodiment of the present invention may include a direction indication switch 10, a vehicle information collector 20, a vehicle information transmitter/receiver 30, a controller 40, and a warning output unit 50.

The direction indication switch 10 may generate a left or right lane change signal according to a driver's operation.

The vehicle information collector 20 may collect vehicle information including vehicle speed, traveling direction, and location.

At this time, the vehicle information collector 20 may collect vehicle speed sensed through a vehicle speed sensor (not illustrated) through CAN (Controller Area Network) communication inside the vehicle in real time, and collect the current traveling direction and location of the vehicle through a GPS (Global Positioning System) or GNSS (Global Navigation Satellite System) module in real time.

Specifically, the vehicle information collector 20 may collect information on the traveling direction of the vehicle 100. The information on the traveling direction may include a heading value indicating at which degrees the vehicle is traveling in case where a reference point is set to zero degrees.

Thus, as the current speed, traveling direction, and location (including map information) of the vehicle 100 are processed in real time, the vehicle information collector 20 may collect vehicle information obtained by calculating at which point on the road the vehicle is traveling at several seconds after the current time.

The vehicle information transmitter/receiver 30 may transmit (broadcast) the vehicle information collected through the vehicle information collector 20, and receive other vehicle information transmitted (broadcast) from a forward vehicle 200*a* and a vehicle 200*b* on the other lane.

At this time, the vehicle information transmitter/receiver 30 may communicate with the forward vehicle 200*a* and the vehicle 200*b* on the other lane in real time, using V2V (Vehicle-to-Vehicle) communication and V2I (Vehicle-to-Infrastructure) based on WAVE (Wireless Access in Vehicular Environments) technology.

That is, the vehicle 100 may transmit (broadcast) the vehicle information collected through the vehicle information collector 20 to the surrounding vehicles 200 and infrastructures (not illustrated) at a predetermined interval of 100 ms, for example, and receive the other vehicle information transmitted (broadcast) from the forward vehicle 200*a* and the vehicle 200*b* on the other lane at a predetermined interval of 100 ms, for example.

At this time, the vehicle information may include the location and state of the vehicle and various pieces of information of the vehicle.

When a lane change signal is inputted through the direction indication switch 10, the controller 40 may determine the lane-change direction through the input lane change signal. Then, the controller 40 may determine whether to output a warning, using the vehicle information collected through the vehicle information collector 20 and the other vehicle information received through the vehicle information transmitter/receiver 30.

More specifically, when the forward vehicle 200*a* is sensed through the other vehicle information received through the vehicle information transmitter/receiver 30, the controller 40 may calculate a distance required for passing the forward vehicle 200*a* (hereafter, referred to as a passing required distance). When the vehicle 200*b* on the other lane is sensed within the calculated passing required distance, the controller 40 may output a warning.

At this time, the passing required distance may be calculated by adding a first distance A, a second distance B, and a third distance C. The first distance A may correspond to a distance from the location of the front bumper of the vehicle 100, collected through the vehicle information collector 20, to the location of the rear bumper of the forward vehicle 200*a*, sensed through the other vehicle information. The second distance B may correspond to the length of the forward vehicle 200*a*, contained in the other vehicle information. The third distance C may correspond to a preset distance between the forward vehicle 200*a* before passed and the vehicle 100*b* after passing the forward vehicle 200*a*.

As illustrated in FIG. 2, the controller 40 may determine whether the forward vehicle 200*a* is traveling in the same direction as the vehicle 100, based on the other vehicle information. When determining that the forward vehicle 200*a* is traveling in the same direction as the vehicle 100, the controller 40 may calculate a distance from the front bumper of the vehicle 100 to the rear bumper of the forward vehicle 200*a*. That is, the first distance A may be measured.

At this time, when a radar installed in the vehicle 100 is used in addition to the location information received from the GPS module, the first distance A may be measured as a more accurate value.

Then, the controller 40 may measure the length of the forward vehicle 200*a* through various pieces of information contained in the other vehicle information. That is, the second distance B may be measured.

When the vehicle 100 passes the forward vehicle 200*a*, the vehicle 100 needs to move to a forward location corresponding to a predetermined distance from the forward vehicle 200*a*, in order to prevent a collision between the vehicles. The distance at this time may correspond to a preset distance between the forward vehicle 200*a* before passed and the vehicle 100*b* after passing the forward vehicle 200*a*. That is, the third distance C may be measured.

In the embodiment of the present invention, the preset distance may be defined on the basis of various standards. For example, a pre-defined distance may be used as the preset distance, or calculated as the square root of current vehicle speed/10. Furthermore, on the road where the speed limit is over 80 Km, the preset distance may be calculated by subtracting 15 from the current vehicle speed (Km/h) and attaching meter (m) to the result value.

The first to third distances A to C measured in such a manner may be added to calculate the distance required for the vehicle 100 to pass the forward vehicle 200*a*.

The vehicle 100 may stably pass the forward vehicle 200*a* only when the passing required distance is secured. Thus, when the vehicle 200*b* on the other lane is located within the passing required distance after the passing required distance is calculated, the controller 40 may immediately output a warning. The passing required distance may be calculated when the direction indication switch 10 is operated.

When the vehicle 200*b* on the other lane is not sensed within the calculated passing required distance, the controller 40 may not output a warning.

As described above, the passing required distance is calculated after the direction indication switch 10 is operated. Thus, when no warning is outputted after the direction indication switch 10 is operated, the vehicle 100 may stably pass the forward vehicle 200*a* to the location of the vehicle 100*a* after passing through the location of the vehicle 100*b* during passing, as illustrated in FIG. 2.

Furthermore, the controller 40 may cancel the warning output, when the input of the lane change signal through the direction indication switch 10 is stopped or the vehicle 200*b* on the other lane is not sensed within the calculated passing required distance.

Furthermore, the controller 40 may determine whether the vehicle speed collected through the vehicle information collector 20 is equal to or more than a preset speed, and operate the apparatus for warning of dangerous passing of a vehicle in accordance with the embodiment of the present invention, only when the vehicle speed is equal to or more than the preset speed.

The warning output unit 50 may output a warning according to the determination of the controller 40.

More specifically, the warning output unit 50 may output a warning using one or more of a warning sound, a warning light, a warning comment, and a warning image. In this case, the warning output unit 50 may change the output intensity or color of the warning according to the location of the vehicle 200*b* on the other lane.

Furthermore, the controller 40 may collect information on the lane located in the direction determined through the lane change signal from the GPS module included in the vehicle information collector 20. Then, the controller 40 may output a passing prohibition warning, when the corresponding lane does not correspond to a passing-allowed section.

At this time, the warning output unit 50 may output a separate warning, for example, a warning comment or warning image which says "This is a passing-prohibited section!".

As described above, when a vehicle is intended to pass a forward vehicle on a road corresponding to a passing-allowed section, the apparatus for warning of dangerous passing of a vehicle in accordance with the embodiment of the present invention may determine whether information on a vehicle traveling in the opposition direction and a passing-required distance are sufficiently secured, through the V2V communication and V2I communication based on the WAVE technology. When determining that passing is dangerous, the apparatus for warning of dangerous passing of a vehicle may warn a driver of the dangerous passing such that the driver stably passes a vehicle, thereby reducing accidents related to passing.

Figure 3:
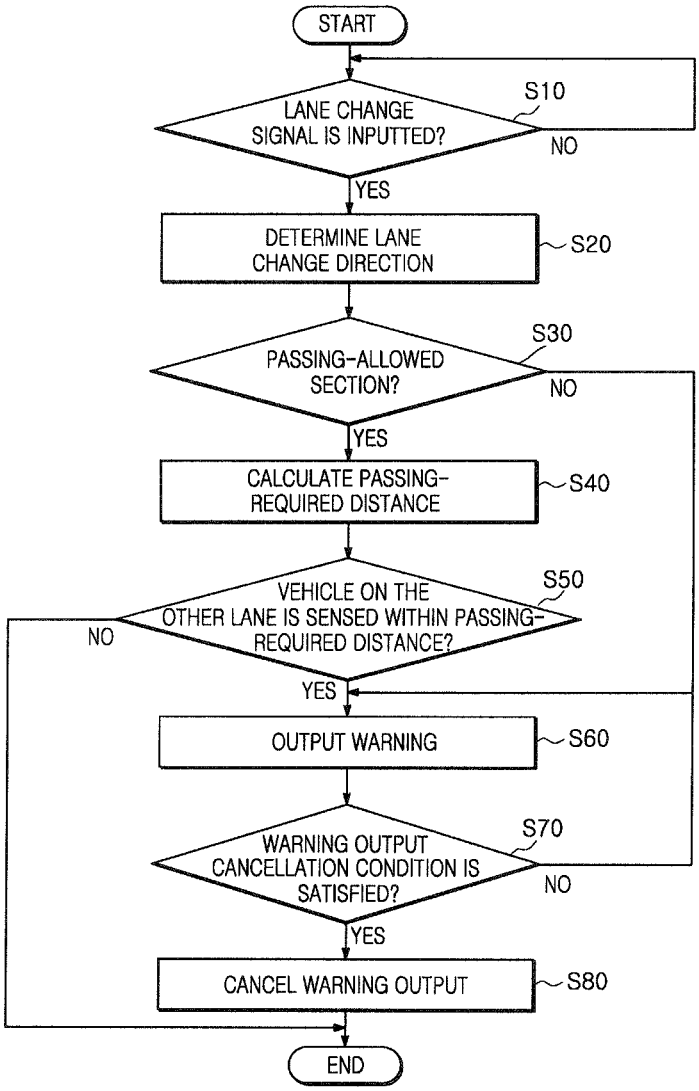
FIG. 3 is a flowchart illustrating a method for warning of dangerous passing of a vehicle in accordance with an embodiment of the present invention.

FIG. 3 is a flowchart illustrating a method for warning of dangerous passing of a vehicle in accordance with an embodiment of the present invention. Referring to FIG. 3, the method for warning of dangerous passing of a vehicle in accordance with the embodiment of the present invention will be described in detail.

First, the controller 40 may determine whether a lane change signal is inputted through the direction indication switch 10, at step S10.

When it is determined at step S10 that the lane change signal is inputted, the controller 40 may determine the direction of the lane change signal at step S20. Then, the controller 40 may collect information on a lane located in the direction of the lane change signal from the GPS module included in the vehicle information collector 20, and determine whether the corresponding lane is a passing-allowed section, at step S30.

When it is determined at step S30 that the corresponding lane is not a passing-allowed section, the controller 40 may output a passing prohibition warning through the warning output unit 50 at step S60.

For example, the controller 40 may output a warning comment or warning output which says "This is a passing-prohibited section!".

When it is determined at step S30 that the corresponding lane is a passing-allowed section, the controller 40 may calculate a distance required for passing a forward vehicle 200*a*, that is, a passing required distance at step S40.

At this time, the passing required distance may be calculated by adding a first distance A, a second distance B, and a third distance C. The first distance A may correspond to a distance from the location of the front bumper of the vehicle 100, collected through the vehicle information collector 20, to the location of the rear bumper of the vehicle 200*a* at the front, sensed through the other vehicle information. The second distance B may correspond to the length of the forward vehicle 200*a*, contained in the other vehicle information. The third distance C may correspond to a preset distance between the forward vehicle 200*a* before passed and the vehicle 100*b* after passing the forward vehicle 200*a*.

The controller 40 may determine whether the vehicle 200*b* on the other lane is sensed within the calculated passing required distance, at step S50. When the vehicle 200*b* on the other lane is sensed, the controller 40 may output a warning through the warning output unit 50 at step S60.

More specifically, the warning output unit 50 may output a warning using one or more of a warning sound, a warning light, a warning comment, and a warning image. In this case, the warning output unit 50 may change the output intensity or color of the warning according to the location of the vehicle 200*b* on the other lane.

Furthermore, the controller 40 may determine whether a warning output cancellation condition is satisfied, at step S70. When the warning output cancellation condition is satisfied, the controller 40 may cancel the warning output at step S80.

At this time, the warning output cancellation condition may be set as follows.

First, when the input of the lane change signal through the direction indication switch 10 is stopped or the vehicle 200*b* on the other lane is not sensed within the passing required distance, the controller 40 may cancel the warning output.

As described above, when a vehicle is intended to pass a forward vehicle on the road corresponding to a passing-allowed section, the apparatus for warning of dangerous passing of a vehicle in accordance with the embodiment of the present invention may determine whether information on a vehicle traveling in the opposition direction and a passing-required distance are sufficiently secured, through the V2V communication and V2I communication based on the WAVE technology. When determining that passing is dangerous, the apparatus for warning of dangerous passing of a vehicle may warn a driver of the dangerous passing such that the driver stably passes a vehicle, thereby reducing accidents related to passing.

Although embodiments of the invention have been disclosed for illustrative purposes, those skilled in the art will appreciate that various modifications, additions and substitutions are possible, without departing from the scope and spirit of the invention as defined in the accompanying claims.

What is claimed is:

1. An apparatus for warning of dangerous passing of a vehicle, comprising:

a vehicle information collector configured to collect vehicle information containing one or more of vehicle speed, traveling direction, and location;

a vehicle information transmitter/receiver configured to transmit the vehicle information collected through the vehicle information collector, and receive other vehicle information transmitted from other vehicles;

a controller configured to determine the direction of a lane change signal when the lane change signal is inputted, and determine whether to output a warning based on the vehicle information collected through the vehicle information collector and the other vehicle information received through the vehicle information transmitter/receiver; and a warning output unit configured to output a warning according to the determination of the controller, wherein the controller calculates a distance required for passing a forward vehicle when the forward vehicle is sensed through the other vehicle information, and outputs the warning when a vehicle on another lane is sensed within the calculated passing required distance.

2. The apparatus of claim 1, wherein the controller calculates the passing required distance by adding a first distance, a second distance, and a third distance, and the first distance corresponds to a distance from the location of the front bumper of the vehicle, collected through the vehicle information collector, to the location of the rear bumper of the forward vehicle, sensed through the other vehicle information, the second distance corresponds to the length of the forward vehicle, contained in the other vehicle information, and the third distance corresponds to a preset distance between the forward vehicle before passed and the vehicle after passing the forward vehicle.

3. An apparatus for warning of dangerous passing of a vehicle, comprising:

a vehicle information collector configured to collect vehicle information containing one or more of vehicle speed, traveling direction, and location;

a vehicle information transmitter/receiver configured to transmit the vehicle information collected through the vehicle information collector, and receive other vehicle information transmitted from other vehicles;

a controller configured to determine the direction of a lane change signal when the lane change signal is inputted, and determine whether to output a warning based on the vehicle information collected through the vehicle information collector and the other vehicle information received through the vehicle information transmitter/receiver; and a warning output unit configured to output a warning according to the determination of the controller, wherein the controller collects information on a lane located in the determined direction of the lane change signal from a GPS (Global Positioning System) module included in the vehicle information collector, and outputs a passing prohibit warning when the lane is not a passing-allowed section.

4. The apparatus of claim 1, wherein the vehicle information transmitter/receiver communicates with the forward vehicle and the vehicle on the another lane through a communication standard based on WAVE (Wireless Access in Vehicular Environments) technology.

5. The apparatus of claim 1, wherein the warning output unit outputs the warning using one or more of a warning sound, a warning light, a warning comment, and a warning image, and changes the output intensity or color of the warning according to the location of the vehicle on the another lane.

6. The apparatus of claim 1, wherein the controller cancels the output warning when the input of the lane change signal through a direction indication switch is stopped or the vehicle on the another lane is not sensed within a distance required for passing the forward vehicle.

7. A method for warning of dangerous passing of a vehicle, comprising:

determining, by a controller, whether a lane change signal is inputted through a direction indication switch;

determining, by the controller, the direction of the lane change signal when the lane change signal is inputted, and determining whether to output a warning using vehicle e information collected through a vehicle information collector and other vehicle information received through a vehicle information transmitter/receiver; and outputting, by the controller, a warning according to the determination, wherein the determining of whether to output the warning comprises calculating a distance required for passing a forward vehicle when the forward vehicle is sensed through the other vehicle information, and outputting the warning when a vehicle on another lane is sensed within the calculated passing required distance.

8. The method of claim 7, wherein the passing required distance is calculated by adding a first distance, a second distance, and a third distance, and the first distance corresponds to a distance from the location of the front bumper of the vehicle, collected through the vehicle information collector, to the location of the rear bumper of the forward vehicle, sensed through the other vehicle information, the second distance corresponds to the length of the forward vehicle, contained in the other vehicle information, and the third distance corresponds to a preset distance between the forward vehicle before passed and the vehicle after passing the forward vehicle.

9. A method for warning of dangerous passing of a vehicle, comprising:

determining, by a controller, whether a lane change signal is inputted through a direction indication switch;

determining, by the controller, the direction of the lane change signal when the lane change signal is inputted, and determining whether to output a warning using vehicle information collected through a vehicle information collector and other vehicle information received through a vehicle information transmitter/receiver; and outputting, by the controller, a warning according to the determination, wherein the determining of whether to output the warning comprises collecting information on a lane located in the determined direction of the lane change signal from a GPS module included in the vehicle information collector, and determining to output a passing prohibition warning, when the lane is not a passing-allowed section.

10. The method of claim 7, wherein the outputting of the warning according to the determination comprises outputting the warning using one or more of a warning sound, a warning light, a warning comment, and a warning image, and changing the output intensity or color of the warning according to the location of the vehicle on the another lane.

11. The method of claim 7, further comprising canceling the warning output when the input of the lane change signal through the direction indication switch is stopped or the vehicle on the another lane is not sensed within a distance required for passing the forward vehicle.

* * * * *